US010895256B2

(12) United States Patent
Kolyshkin et al.

(10) Patent No.: US 10,895,256 B2
(45) Date of Patent: Jan. 19, 2021

(54) STATOR AND ROTOR PROFILE FOR IMPROVED POWER SECTION PERFORMANCE AND RELIABILITY

(71) Applicant: Schlumberger Technology Corporation, Sugar Land, TX (US)

(72) Inventors: Anton Kolyshkin, Katy, TX (US); Maxim Pushkarev, Edmonton (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 149 days.

(21) Appl. No.: 16/214,182

(22) Filed: Dec. 10, 2018

(65) Prior Publication Data

US 2019/0186204 A1 Jun. 20, 2019

Related U.S. Application Data

(60) Provisional application No. 62/598,615, filed on Dec. 14, 2017.

(51) Int. Cl.
*F04C 2/107* (2006.01)
*F01C 1/10* (2006.01)
(Continued)

(52) U.S. Cl.
CPC ..... *F04C 2/1073* (2013.01); *F01C 1/101* (2013.01); *F04C 2/10* (2013.01); *F04C 2/1071* (2013.01);
(Continued)

(58) Field of Classification Search
CPC .. F01C 1/101; F04C 2240/10; F04C 2240/20; F04C 2250/20; F04C 2250/30; F04C 2/10; F04C 2/1071; F04C 2/1073; F04C 2/1075
See application file for complete search history.

(56) References Cited

U.S. PATENT DOCUMENTS 1,892,217 A 12/1932 Moineau
2,389,728 A 11/1945 Hill
(Continued)

FOREIGN PATENT DOCUMENTS

WO 2015047405 A1 4/2015

OTHER PUBLICATIONS

Aage et al., Mathematical problems for Moineau pumps, Technical University of Denmark, 2006.
(Continued)

*Primary Examiner* — Mary Davis

(57) ABSTRACT

A progressing cavity pump or a positive displacement motor includes an external member having three or more lobes and an internal member extending through the external member and having one less lobe than the external member. One of the internal member and the external member rotates with respect to the other. The curvature of a profile of each of the internal member and external member is finite at all points. A ratio of a lobe volume of the external member to a valley volume of the external member enclosed between a minor external member diameter and a major external member diameter is between 0.9 and 1.2. A lobe height of the external member is related to a ratio of a minor internal member diameter to one less than the number of internal member lobes.

16 Claims, 6 Drawing Sheets

(51) Int. Cl.
*F04C 2/10* (2006.01)
*F04C 13/00* (2006.01)

(52) U.S. Cl.
CPC ..... *F04C 2/1075* (2013.01); *F04C 13/008* (2013.01); *F04C 2240/10* (2013.01); *F04C 2240/20* (2013.01); *F04C 2250/20* (2013.01); *F04C 2250/30* (2013.01)

(56) References Cited

U.S. PATENT DOCUMENTS

| | | | | |
|---|---|---|---|---|
| 3,208,391 | A * | 9/1965 | Lindberg | F04C 2/1073 418/48 |
| 4,909,337 | A | 3/1990 | Kochnev et al. | |
| 2007/0172371 | A1 | 7/2007 | Podmore | |
| 2007/0220749 | A1 * | 9/2007 | Lee | F04C 2/10 29/893 |

OTHER PUBLICATIONS

Gravesen, Jens, The geometry of the Moineau pump, Technical University of Denmark, 2008.
Hsieh et al., Geometric Design for a Gerotor Pump With High Area Efficiency, National Chung-Cheng University, Taiwan., 2007.
Search and Examination Report R. 62 issued in European Patent Application 18211237.5 dated Feb. 11, 2019, 5 pages.

* cited by examiner

STATOR AND ROTOR PROFILE FOR IMPROVED POWER SECTION PERFORMANCE AND RELIABILITY

CROSS-REFERENCE TO RELATED APPLICATIONS

This application claims priority to and the benefit of U.S. Provisional Patent Application No. 62/598,615, filed on Dec. 14, 2017, which is herein incorporated by reference in its entirety.

BACKGROUND

Moving cavity motors or pumps, sometimes known as positive displacement motors or pumps, or progressive or progressing cavity motors or pumps, work by trapping fluid in cavities. The cavities are formed in spaces between the rotor and the stator, and the relative rotation between these members is the mechanism which causes the cavities to progress and travel axially along the length of the device from the input end to the output end. If the rotor is forced to rotate, fluid is drawn along in the cavities, and the device will be a pump. If the fluid is pumped into the input end cavity at a higher pressure than that at the outlet end, the forces generated on the rotor cause it to rotate and the device will be a motor.

A mud motor may be used as the power section of a downhole assembly to power drilling operations. A mud motor may be a positive displacement motor. The mud motor may be particularly advantageous in directional drilling. However, currently used mud motors have shortcomings that can lead to failure of the motor and therefore the downhole assembly.

An external member of the mud motor, which may often be a stator, may include an elastomer portion, and the internal member may often be referred to as a rotor. Most failures of mud motors may be due to failure of the elastomer. For example, the mud motor may fail by chunking, wherein the elastomer is torn away as a result of fatigue or tensile fracture. The mud motor may also fail by debonding, wherein the elastomer separates from a metal casing of the external member. The mud motor may fail due to poor fit between the external member (such as a stator) and an internal member (such as a rotor), caused by degradation of the elastomer of the external member or the metal of the internal member. The mud motor may fail due to thermal degradation of the internal member caused by high downhole temperatures. Particulates in the drilling fluid may contribute to the degradation of the internal and external members.

SUMMARY OF THE DISCLOSURE

In one aspect, this disclosure relates to a progressive cavity pump or a positive displacement motor which may include an external member having three or more lobes and an internal member extending through the external member and having one less lobe than the external member. One of the internal member and the external member rotates with respect to the other. The curvature of a profile of each of the internal member and external member is finite at all points. A ratio of a lobe volume of the external member to a valley volume of the external member enclosed between a minor external member diameter and a major external member diameter is between 0.9 and 1.2. A lobe height of the external member is related to a ratio of a minor external member diameter to one less than the number of external member lobes.

In another aspect, this disclosure relates to a progressive cavity pump or positive displacement motor which may include an external member and an internal member within the external member. One of the internal member and the external member rotates with respect to the other. The progressive cavity pump or positive displacement motor has a two-dimensional contact line that is a projection of a three-dimensional sealing line between the internal member and the external member, and the two-dimensional contact line is an ellipse, a limaçon, or a closed convex spline.

Other aspects and advantages will be apparent from the following description and the appended claims.

DETAILED DESCRIPTION

Figure 2:
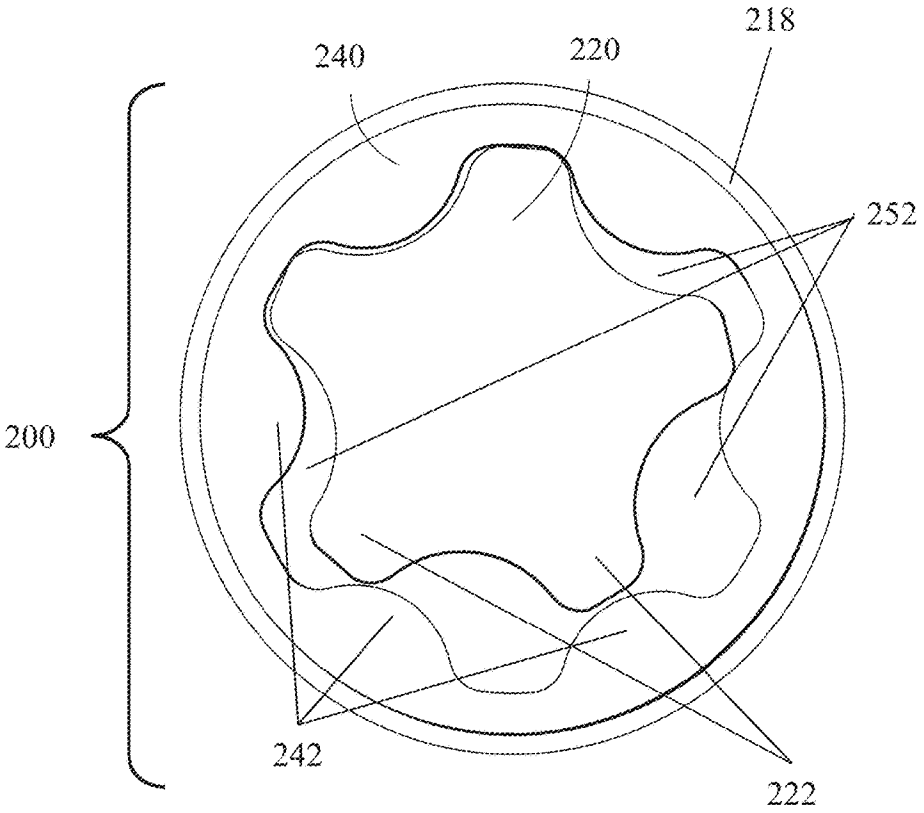
FIG. 2 is a cross-section view of a positive displacement motor in accordance with the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Figure 1:
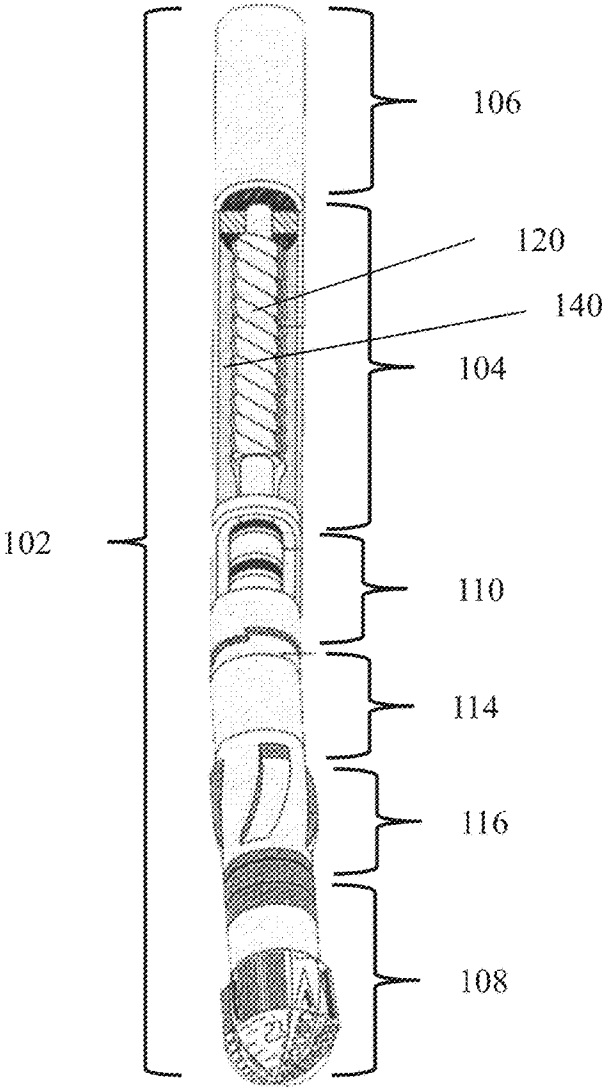
FIG. 1 is a downhole assembly in accordance with the present disclosure.

In one aspect, the present disclosure relates to a positive displacement motor including a rotor and a stator. Often, the stator may be the external member in which the internal rotor rotates; however, it is understood that the reverse is also envisioned for any of the described embodiment, where the external member rotates (as a rotor) around an internal member (stator), e.g., a static internal member. Thus, any reference to the rotor as the internal member and the stator as the external member is not limited to such configuration. The positive displacement motor may comprise the power section of a bottomhole assembly. FIG. 1 shows a bottomhole assembly 102. A proximal end of the bottomhole assembly 102 may be attached to a drill string 106. The drill string 106 may extend from the surface of a wellbore (not shown) to the proximal end of the bottomhole assembly 102. During operation of the bottomhole assembly 102, mud may be pumped through the drill string 106 and into the bottomhole assembly 102. Although embodiments of the disclosure are described relating to a positive displacement motor, it is understood that, upon reading the disclosure, one of ordinary skill in the art would appreciate that the embodiments may also apply to a progressive cavity pump in other applications without going beyond the scope of the disclosure.

The bottomhole assembly 102 may include a power section 104. The power section 104 may be a part of the positive displacement motor. The power section 104 may include a rotor 120 and a stator 140. During operation, mud may flow through the power section 104. The mud may cause the rotor 120 to rotate relative to the stator 140.

The bottomhole assembly 102 may include a drill bit 108 located at a distal end of the bottomhole assembly 102. The rotation of the rotor 120 may be transferred to the drill bit 108. The rotation of the drill bit 108 may cut or shear the formation (not shown) surrounding the bottomhole assembly 102, and may thereby deepen the wellbore during operation.

The power section 104 may be connected to the drill bit 108 via a bearing assembly 110. The bearing assembly 110 may include radial and thrust bearings and bushings, for example. The bearing assembly 110 may transmit axial and radial loads from the drill bit 108 to the drill string 106 and may provide a drive line that allows the power section 104 to rotate the drill bit 108. The bearing assembly 110 may or may not be sealed. If the bearing assembly 110 is not sealed, mud may flow through the bearing section 110. The mud may act to lubricate the bearing assembly 110.

The bottomhole assembly 102 may include a joint 114 and an adjustable assembly 116. The joint 114 may be a universal joint. The joint 114 may allow a distal portion of the bottomhole assembly 102 to tilt relative to a proximal portion of the bottomhole assembly 102 with two or more degrees of freedom. The joint 114 may allow the power section 104 to transmit a rotation, but not a translation, to the drill bit 108. The adjustable assembly 116 may allow an angle of the bottomhole assembly 102 to be adjusted from the surface. The adjustable assembly 116 may allow the bottomhole assembly 102 to be used for directional drilling, in which a non-vertical well is drilled.

Mud may exit the bottomhole assembly 102 through drill bit 108 and flow back to the surface of a wellbore, allowing mud to continuously flow through the power section 104 while the bottomhole assembly 102 is in operation. The rate at which mud flows through the power section 104 may determine the rate at which the rotor 120 rotates and thereby determine the rate at which the drill bit 108 rotates. Mud which exits the downhole assembly 102 may lubricate the drill bit 108 before flowing back to the surface of the wellbore.

FIG. 2 shows a cross-section view of a positive displacement motor 200. As noted above, features described herein may be applied to a progressive cavity pump without going beyond the scope of the disclosure. As shown, the positive displacement motor 200 may include an internal rotor 220 and an external stator 240. The rotor 220 may be disposed within the stator 240. The positive displacement motor 200 may include a casing 218 disposed around the outside of the stator 240. The rotor 220 may be a solid cylinder or bar with a lobed outer surface. The stator 240 may be a hollow cylinder or other member with a lobed inner surface.

The rotor 220 may have any number of lobes 222. In some embodiments, the rotor 220 may have two or more lobes 222. In some embodiments, the rotor 220 may have three or more lobes 222. For example, in the embodiment shown in FIG. 2, the rotor 220 may have five lobes 222. The lobes 222 of the rotor 220 may have a spiral configuration along the length of the rotor 220.

The stator 240 may have one more lobe 242 than the rotor 220. For example, in the embodiment shown in FIG. 2, the stator may have six lobes 242. The stator 240 may have any number of lobes 224. The number of lobes 242 which comprise a given stator 240 may be limited only by the number of lobes 222 of the corresponding rotor 220. The lobes 242 of the stator 240 may have a spiral configuration along the length of the stator 240.

The rotor 220 and the stator 240 may contact each other. In any two-dimensional cross of the positive displacement motor 200, the contact may occur at contact points. The contact points may form three-dimensional lines of contact (not shown) along the length of the positive displacement motor 200. Cavities 252 may be formed between the three-dimensional contact lines. The rotor 220 and the stator 240 may seal against each other along the three-dimensional contact lines, such that the cavities 252 are not in fluid communication with each other.

The rotor 220 and the stator 240 may rotate relative to each other. The rotation may be caused by pumping a fluid through the positive displacement motor 200. The fluid may move substantially linearly (e.g., axially) along the length of the positive displacement motor 200 and the linear motion (e.g., axial progression) of the fluid may be transformed into a rotation of rotor 220. The fluid may fill the cavities 252 of the positive displacement motor 200. The three-dimensional contact lines and the cavities 252 may be dynamic. In other words, as the fluid flows through the positive displacement motor 200 and rotor 220 rotates, the three-dimensional contact lines and the cavities 252 rotate and translate.

The rotor 220 and the stator 240 of a positive displacement motor 200 may rotate relative to each other. As discussed above, in the illustrated embodiment, the internal member is the rotor (and rotates) while the external member (the stator) is rotationally stationary; however, it is also understood that in some embodiments, the external member may be the rotor (and rotate) and the internal member may be rotationally stationary. Further, it is also envisioned that both members may rotate. For example, the central axis of either the internal member or the external member may circumscribe a circular-like trajectory around the central axis of the other of the internal member or the external member, and both the internal and external members may rotate, e.g., both members may rotate though they also rotate with respect to one another. The torque produced by the positive displacement motor 200 may be proportional to the pressure drop of the fluid flowing through the positive displacement motor 200. In some embodiments, if the rotor 220 and the stator 240 of a positive displacement motor 200 have more lobes, the operational torque may be higher and the rotational speed may be lower.

In some embodiments, as shown in FIG. 1, an internal member 120 of a positive displacement motor may be a rotor and an external member 140 of a positive displacement motor may be a stator, especially if the positive displacement motor functions as the power section 104 of a downhole assembly 102. In some embodiments, an internal member 220 of a positive displacement motor may act as a stator and an external member 240 of a positive displacement motor may act as a rotor, especially if the positive displacement motor 200 is used in applications other than a bottomhole assembly.

The internal rotor 220 may be made of one or more metals. In some embodiments, the rotor 220 may be made of steel coated with another metal, such as chromium. The coating metal may form a smooth, hard, wear-resistant surface on the rotor 220. The stator 240 may be made of steel lined with an elastomer. The casing 218 may be made of one or more metals, including but not limited to steel.

In this disclosure, a positive displacement motor has been described as the power section for a bottomhole assembly. However, the positive displacement motor or progressive cavity pump described herein may be used for other applications without departing from the scope of the present disclosure.

Traditionally, positive displacement motors 200 have been developed having rotors 220 and stators 240 described by the Moineau mechanism. Rotors 220 and stators 240 developed according to the Moineau mechanism may have either epi-hypo cycloidal profiles or profiles constructed as splines equidistantly shifted from hypocycloidal curves. A Moineau mechanism may be constructed with either epicycloidal or hypocycloidal profiles joined with a radial arc. Alternatively it can be composed as splines equidistantly shifted from hypocycloidal or epicycloidal curves also joined with a radial arc. Additionally, Moineau mechanisms may be designed as a combination of both epicycloidal and hypoycloidal splines.

Although the rotors 220 and stators 240 suggested by the Moineau mechanism are kinematically and mathematically correct, they have some disadvantages for real applications. Members 220, 240 designed according to the Moineau mechanism necessarily have points of infinite curvature. These points may be referred to as cusps. The cusps are difficult to manufacture using practical means. Further, the high curvature area surrounding a cusp would produce stresses in the elastomeric portion of the stator 240, eventually leading to damage to or failure of the material.

Several modifications for positive displacement motors 200 designed by the Moineau mechanism are known, but all have shortcomings. In some cases, an artificial smooth fillet may be created around the cusp. The fillet may alter the interaction between the rotor 220 and the stator 240, leading to a higher leakage between the rotor 220 and the stator 240, decreasing the efficiency of the positive displacement motor 200. The fit between the rotor 220 and the stator 240 may be artificially increased, but may lead to higher stress in the elastomer of the stator 240 and ultimately to a shorter life of the positive displacement motor 200.

In some cases, the Moineau profiles may be substituted with the profiles constructed on alternative curves such as a combination of two tangentially joined convex and concave circular arcs. This approach may provide rotors 220 and stators 240 with a smooth profile that is easy to manufacture. However, this approach may also lead to higher stress in the elastomer of the stator 240 and ultimately to a shorter life of the positive displacement motor 200.

A profile known as an improved Moineau profile, which can be described by the equidistance of shortened hypo- or epi-cycloidal curves, has been developed which overcomes some of the shortcomings of the earlier attempts to modify the Moineau profile. However, the improved Moineau profile conventionally could not produce a mechanism which tolerates both high eccentricity and an adequate shape for a rotor 220 and a stator 240 which can be used as the power section of a bottomhole assembly. The power section of a bottomhole assembly may be required to work at a high flow rate and generate a large amount of power. An improved Moineau profile with high eccentricity may necessarily have a rotor 220 with narrow lobes and a stator 240 with thick lobes. This may cause stress in the elastomer of the stator 240 and may cause self-overheating in the rotor 220 due to a hysteresis effect. These problems may drastically reduce the lifespan of the positive displacement motor 200.

Figure 3:
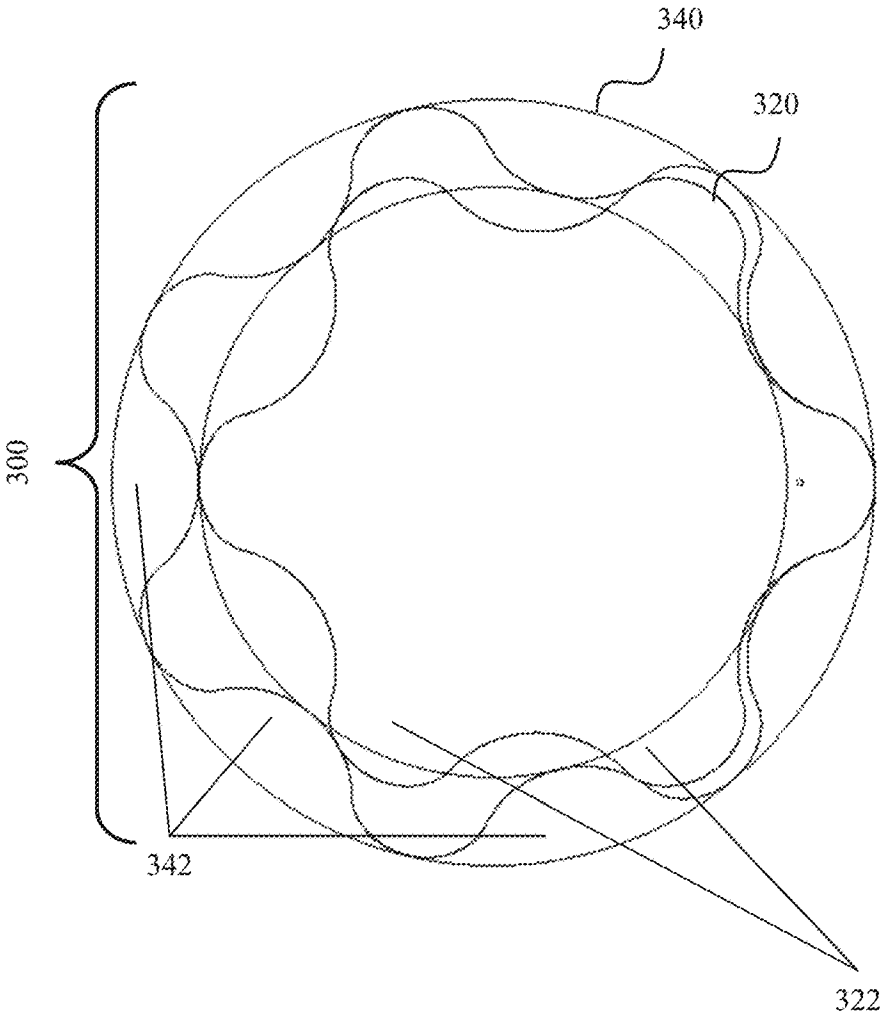
FIG. 3 is a cross-section view of a positive displacement motor in accordance with the present disclosure.

The present disclosure relates to a positive displacement motor 300, illustrated in FIG. 3, featuring improved profiles of the rotor 320 and the stator 340 which may overcome the shortcomings of previously developed positive displacement motors. Specifically, embodiments of the present disclosure may have substantially similar lobe thicknesses, high eccentricity, relative smoothness (free of cusps or high curvature).

The thickness of the lobes 322 of the rotor 320 and the thickness of the lobes 342 of the stator 340 may be substantially similar. This may provide a more predictable and desirable stress pattern in the elastomer portion of the stator 340. This may also provide an extended lifespan of the rotor 320.

The profile of the rotor 320 and the stator 340 may be designed based on a ratio "h" which is the maximum lobe height, for which kinematically perfect rotor and stator profiles can be created.

The ratio h may be expressed by the following equation:

$$h=D_{mean}/Z_r$$

where $D_{mean}$ is the mean diameter of the rotor 320 and $Z_r$ is the number of lobes 322 of the rotor 320. The mean diameter of the rotor 320 may be calculated as the average of a maximum diameter measured at the outermost points of the lobes 322 and a minimum diameter measured at the innermost points of the valleys formed between the lobes 322. (An exemplary valley is labeled in FIG. 3). The ratio "h" may have dimensions of length. In some embodiments, the lobe height "H" may be chosen based on the ratio "h."

The lobe height is related to the eccentricity of the rotor 320 and the stator 340. The lobe height may be about equal to double the eccentricity (the distance between the rotor centerline and the stator centerline). The positive displacement motor 300 of the present disclosure may have a high eccentricity. A high eccentricity may be an eccentricity that is relatively higher than eccentricities commonly used in previous positive displacement motors. The eccentricity may be a measure of how much the center of the rotor 320 is displaced during operation of the positive displacement motor 300. The eccentricity may be about half of the rotor lobe height. High eccentricity profiles of the rotor 320 and stator 340 may provide greater power and lower no-load pressure when compared to low eccentricity profiles having the same profile length and revolution per gallon ratio. This may result in higher efficiency.

However, an eccentricity that is too high may lead to partially disrupted contact between the rotor 320 and the stator 340. The disrupted contact may lead to an increased abrasion rate and a reduction of the fatigue life.

The inventors of the present disclosure have found that a compromise may be reached between performance and reliability. Thus, in one or more embodiments of the present disclosure, the positive displacement motor 300 may have an eccentricity defined by the following equation:

$$E=(0.95\ldots1.05)*D_{min}/(2*(Z_s-1))$$

where E is the eccentricity, $D_{min}$ is the minor diameter of the stator 340, where the minor diameter is measured at the lowest points of the valleys of the stator lobes 342, and $Z_s$ is the number of lobes 342 of the stator.

Thus, given the relationship between eccentricity and stator lobe height, the stator 340 of positive displacement motor 300 may have a stator lobe height $H_s$ defined by the following equation:

$$H_s=(0.95 \ldots 1.05)*(D_{min}/(Z_s-1)).$$

Similarly, the rotor 320 of the positive displacement motor 300 may have a rotor lobe height $H_r$ defined by the following equation:

$$H_r=(0.95 \ldots 1.05)*(D_{mean}/Z_r)$$

where $D_{mean}$ is the mean rotor diameter and $Z_r$ is the number of lobes of the rotor. Thus, the rotor height $H_r$ may also be expressed as ranging between 0.95 h and 1.05 h, where h is the ratio defined above.

Figure 4:
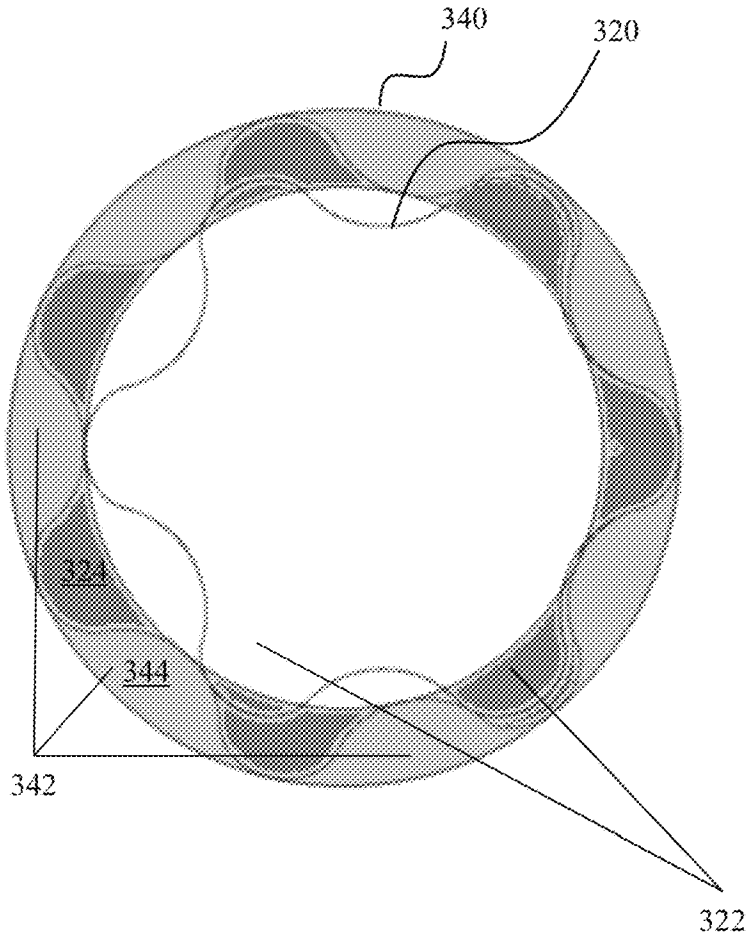
FIG. 4 is a cross-section view of a positive displacement motor in accordance with the present disclosure.

The thickness of the lobes 322, 342 of the rotor 320 and the stator 340 may be characterized as a ratio LV (lobe: valley) between the lobe volume 344 of the stator 340 and the valley volume 324 of the stator 340. The stator valley volume 324 and stator lobe volume 344 may be defined by the surface of stator 340 and concentric circles that are formed tangent to the peaks and valleys of the stator lobes 342. A geometric representation of the ratio LV is shown in FIG. 4, where the stator valley volume 324 is shown in dark gray and the stator lobe volume 344 is shown in light gray. The stator valley volume 324 (and/or the stator lobe volume 344) may be used to approximate the volume of rotor lobes, and thus the LV ratio may also be considered to approximate the ratio of the stator lobe volume to the rotor lobe volume.

In one or more embodiments, the positive displacement motor 300 of the present disclosure may have an LV ratio between 0.9 and 1.2. Thus, the rotor lobe thickness and the stator lobe thickness of the positive displacement motor 300 may be substantially similar. The inventors of the present disclosure have found that an LV ratio in this range may prevent positive displacement motor 300, especially the elastomer portion of the stator 340 from experiencing extra strain, especially when operated at higher torques. An LV ratio in this range may provide a positive displacement motor 300 with improved performance, in terms of the operating torque and rotational speed relative to the pressure. A positive displacement motor 300 having an LV ratio in this range may experience lower hysteresis heat build-up, contact pressure, and abrasion wear than a motor having an LV ratio greater than this range (i.e., have relatively thick stator lobes).

Finally, as mentioned above, the positive displacement motors 300 of the present disclosure may be relatively smooth and not have cusps or areas with high curvature. Rotor 320 and stator 340 profiles with high eccentricity and without cusps may be designed such that the profile convexity grows from the peak tip of a lobe 322, 342 to an inflection point and the profile concavity grows from the valley tip of a valley to the inflection point. The inflection point may be approximately halfway between the peak tip and the valley tip. In accordance with embodiments of the present disclosure, the convexity may have a finite maximum near the inflection point. Further, also in accordance with embodiments of the present disclosure, the concavity may have a finite maximum near the inflection point. Thus, in one or more embodiments, the convexity and/or the concavity of the rotor and/or stator may not be infinite at any point of the profile. Avoiding infinite curvature, either concavity or convexity, may ensure the rotor 320 and the stator 340 can be manufactured precisely and ensure proper contact between the rotor 320 and stator 340 can be established. In one or more embodiments, the profile may have a ratio of the curvature at the peak tip to the inflection point that is up to 10. Finite element analysis (FEA) modeling may show that profiles having cusps or high curvature areas may generate more stress and contact pressure on rubber as well as manufacturing difficulties than the profiles of the present disclosure.

Unlike earlier methods, the profiles of the present disclosure may provide the best balance in performance and reliability for a positive displacement motor used as the power section of a downhole assembly. Specifically, positive displacement motors designed according to the present disclosure may be able to have a wide range of eccentricity, a wide range of lobe thickness, and have smooth rotor/stator profiles.

Figure 5:
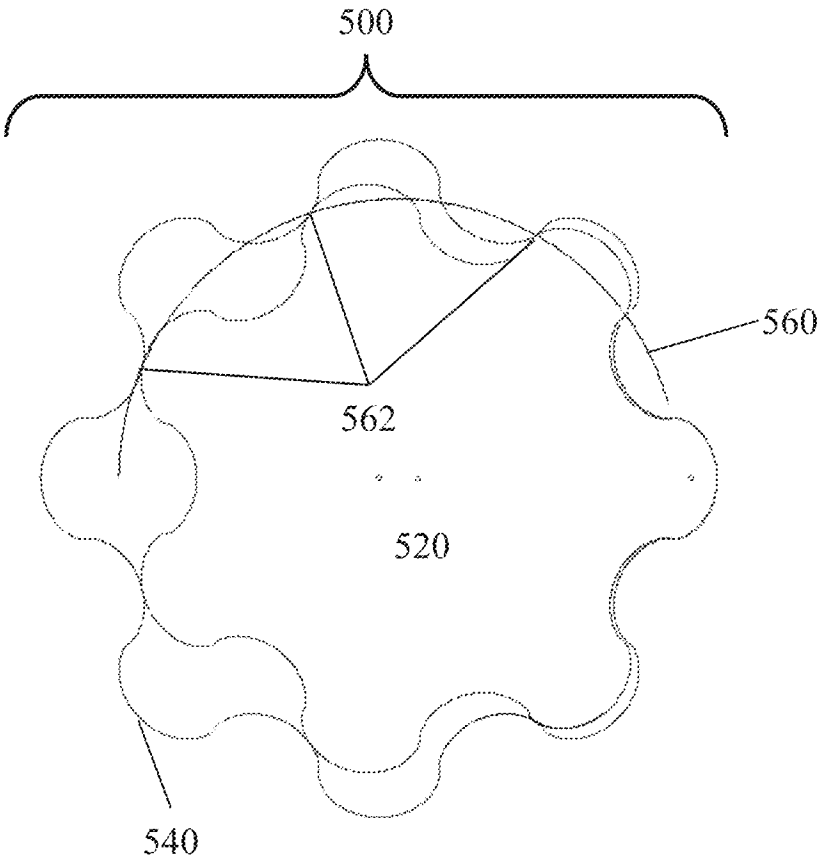
FIG. 5 is a cross-section view of a positive displacement motor in accordance with the present disclosure.

Further, the above rotor/stator parameters in a positive displacement motor may also demonstrate unique contact lines therebetween, as shown, for example in the motor 500 of FIG. 5. A contact line 560 may be the two-dimensional projection of the three-dimensional sealing line formed by the points 562 at which the rotor 520 contacts the stator 540 (specifically, when the rotor lobe contacts the stator lobe). In accordance with the present disclosure, the contact line 560 may be an ellipse (including a circle, i.e., a perfect ellipse, or a super-ellipse), an oval, a limaçon, a closed egg-shape curve, a closed convex, or a closed convex-concave spline. Conventionally, most positive displacement motors may have a contact line having an egg-like shape, rather than an ellipse. Thus, the contact line 560 may be defined by a known equation that can be expressed analytically. For example, referring to FIG. 5, the contact line 560 may substantially fit to an equation (1) representing an elliptical curve in polar coordinates:

$$r=\frac{R}{1-c}\frac{c(1-\varepsilon^2)+\sqrt{1-s^2}\sqrt{1-s^2\cos^2\varphi-c^2\sin^2\varphi}}{1-\varepsilon^2\cos^2\varphi} \tag{1}$$

where ε is the elliptical contact line eccentricity; c is the ratio of distance between stator center and the ellipse focus to major semi-axis; and R is the stator minor radius. If the contact line 560 is an ellipse, the center of the stator 520 may be coincident with a focus of the ellipse.

For the positive displacement motor 500 shown in FIG. 5, the contact line 560 is elliptical and has an elliptical contact line eccentricity of 0.07. Further, the rotor/stator also have an LV value of 1.01, and a stator lobe height $H_s$ of 1.05*(D min/($Z_s$−1)).

Figure 6:
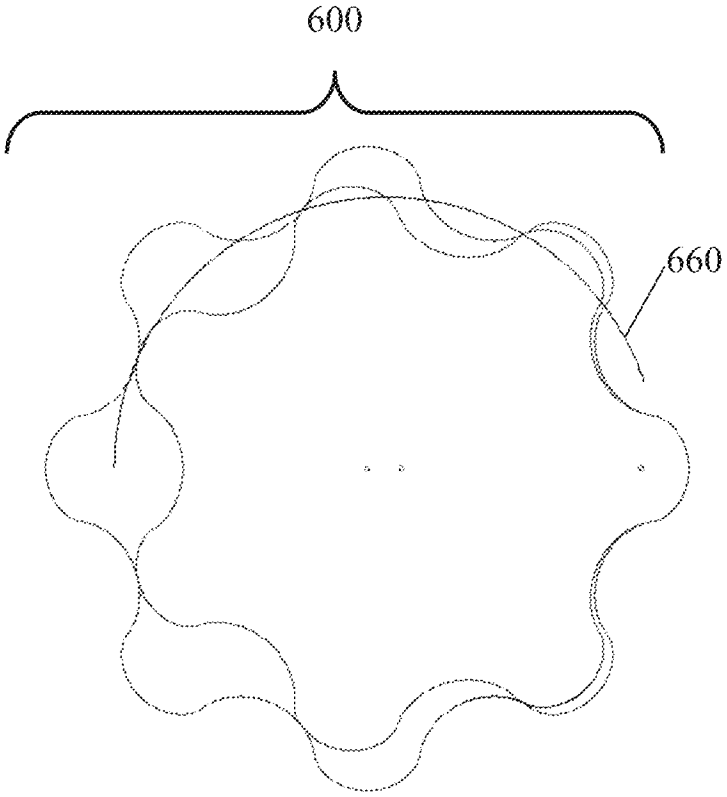
FIG. 6 is a cross-section view of a positive displacement motor in accordance with the present disclosure.

FIG. 6 illustrates another embodiment of the positive displacement motor 600 having an elliptical contact line 660, which also substantially fits to Eq. (1) above. The positive displacement motor 600 may have an LV ratio of 1.1 and may have a stator lobe height $H_s$ of 0.95*($D_{min}$/($Z_s$−1)).

The positive displacement motor 600 may have the improved properties described above. The positive displacement motor 600 may have good performance and reliability as a power section of a downhole assembly.

Figure 7:
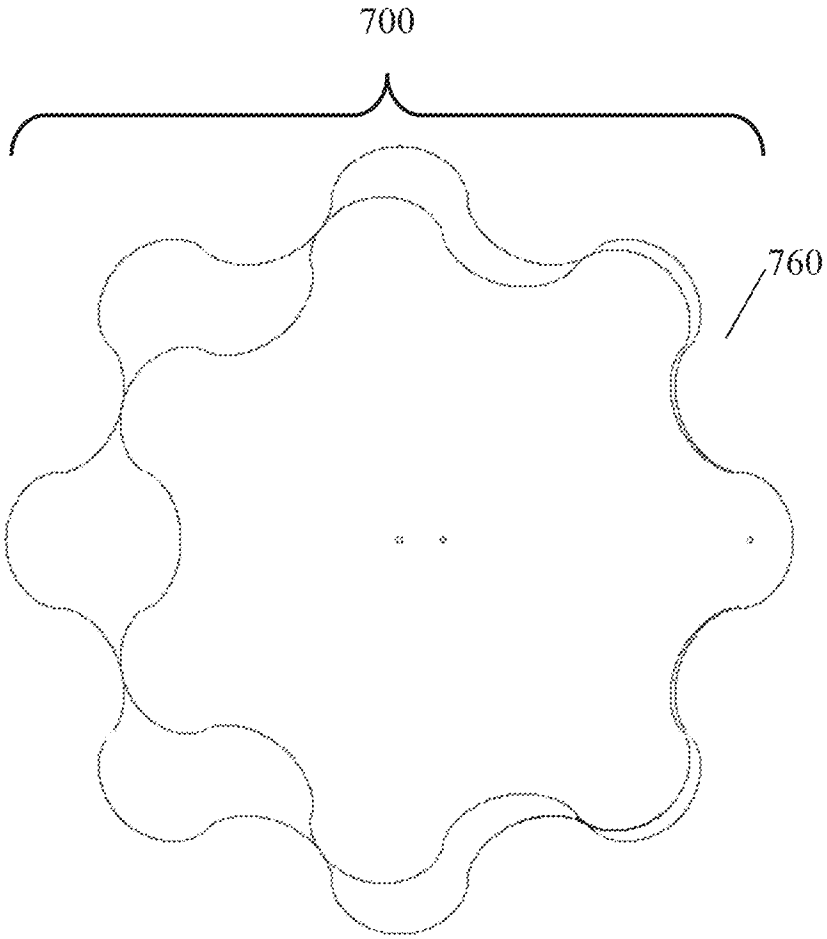
FIG. 7 is a cross-section view of a positive displacement motor in accordance with the present disclosure.

Referring now to FIG. 7 illustrates another embodiment of the positive displacement motor 700 having an limaçon contact line 760, which substantially fits to an equation (2) representing a limaçon curve in polar coordinates:

$$r=R*(1+\varepsilon*\cos(\varphi))/(1-\varepsilon) \tag{2}$$

where R is the stator minor radius; ε is the eccentricity of the limaçon contact line. The positive displacement motor 700 may have an LV ratio of 1.092, an a value of 0.065, and may have a stator lobe height $H_s$ of $1.0*(D_{min}/(Z_s-1))$.

Equation (2) may be simplified to canonical form:

$$r=a+b\cos\theta \quad (3)$$

where, $a=R/(1-\varepsilon)$, $b=R\varepsilon/(1-\varepsilon)$, and $\varepsilon=0.065$.

The positive displacement motor 700 may have the improved properties described above. The positive displacement motor 700 may have good performance and reliability as a power section of a downhole assembly. The method disclosed herein may be used to design and produce a positive displacement motor having the properties described above or to design and produce a positive displacement motor having properties that are different from those described above. The method disclosed herein may be used to design and produce a positive displacement motor which is optimized for use as a power section of a downhole assembly. The method disclosed herein may allow a positive displacement motor to be customized for the needs of specific downhole situations.

The positive displacement motor described in this disclosure may have advantages over previously developed positive displacement motors, e.g., for use as a power section in a downhole assembly. In addition to the advantages which have been described throughout the disclosure, the positive displacement motor described herein may be more resistant to failure when used in a downhole assembly. For example, the positive displacement motor may be more resistant to chunking, debonding, thermal fatigue of the stator, degradation of the rotor and the stator, resulting poor fit between them, and degradation due to particulates. Thus, the positive displacement motor disclosed herein may have an extended lifespan in a downhole environment and may need fewer repairs. The positive displacement motor may be less likely to fail, leading to failure at other parts of the wellbore operation.

The method disclosed herein may have similar advantages for developing a progressive cavity pump for use downhole, e.g., in a downhole assembly.

EXAMPLES

Example 1

Figure 8:
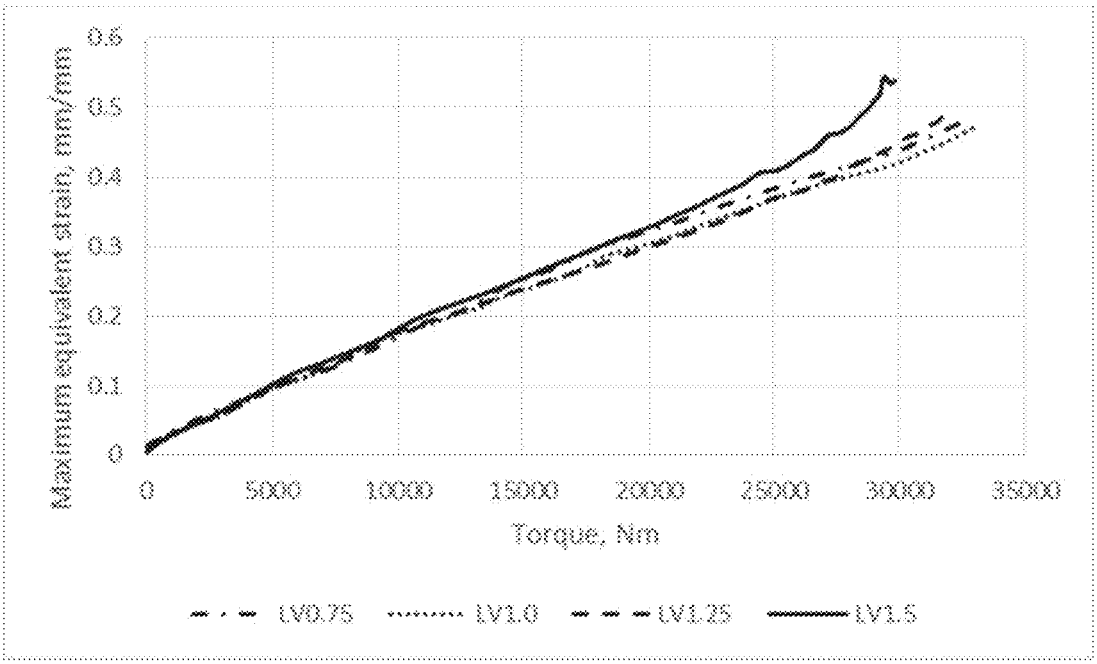
FIG. 8 shows strain in the rubber lining for various rotor/stator profiles.
Figure 9:
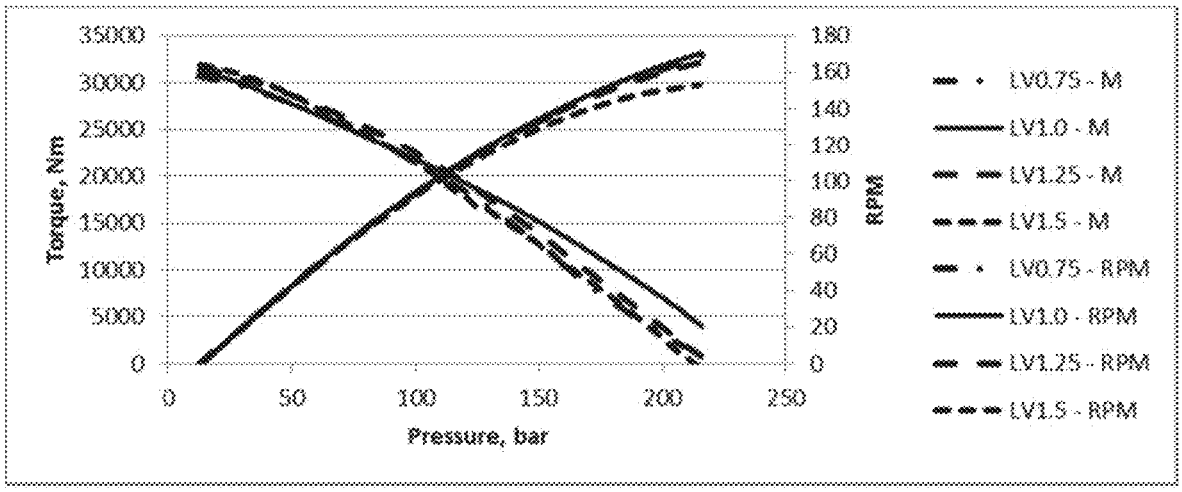
FIG. 9 shows motor performance for various rotor/stator profiles.

Rotor/stator combinations having varying LV ratios (0.75, 1.0, 1.25, and 1.5) were modeled, and the performance of each were compared. FIG. 8 shows a comparison of the strain in the rubber lining of the stator for a variety of LV ratios, and FIG. 9 shows motor performance for a variety of LV ratios. Example 2

Figure 10:
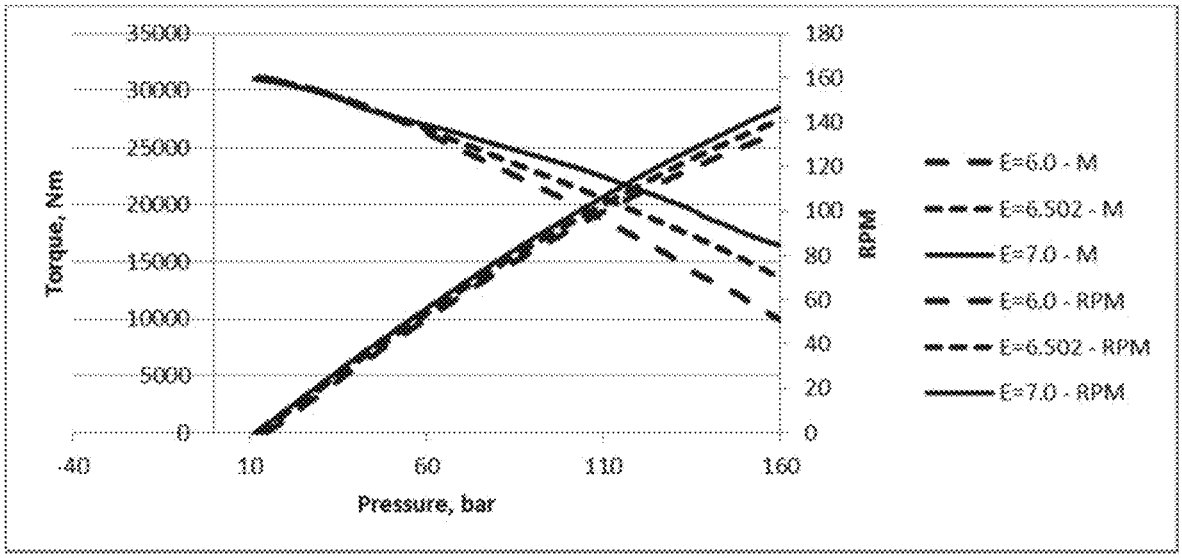
FIG. 10 shows motor performance for various eccentricities.

Motors having a variety of eccentricities (6.0, 6.502, and 7.0 mm) were modeled and the performance of each were compared. FIG. 10 shows a comparison of the motor performance for the variety of eccentricities. While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A progressive cavity pump or a positive displacement motor comprising:

an external member comprising three or more lobes; and an internal member extending through the external member and comprising one less lobe than the external member, wherein one of the internal member and the external member rotates with respect to the other, wherein a curvature of a profile of each of the internal member and external member is finite at all points, wherein a ratio of a lobe volume of the external member to a valley volume of the external member enclosed between a minor external member diameter and a major external member diameter is between 0.9 and 1.2, and wherein a lobe height of the external member is related to a ratio of the minor diameter of the external member to one less than the number of lobes of the external member.

2. The progressive cavity pump or positive displacement motor of claim 1, wherein the lobe height of the external member is between 0.95 and 1.05 times the ratio of the minor diameter of the external member to one less than the number of lobes of the external member.

3. The progressive cavity pump or positive displacement motor of claim 1, wherein a convexity of the external member profile increases from a peak tip to an inflection point and has a finite maximum near the inflection point.

4. The progressive cavity pump or positive displacement motor of claim 1, wherein a concavity of the external member profile increases from a valley tip to an inflection point and has a finite maximum near the inflection point.

5. The progressive cavity pump or positive displacement motor of claim 1, wherein a lobe height of the internal member is related to a ratio of the mean diameter to the number of the lobes of the internal member.

6. The progressive cavity pump or positive displacement motor of claim 1, wherein a convexity of the internal member profile increases from a peak tip to an inflection point and has a finite maximum near the inflection point.

7. The progressive cavity pump or positive displacement motor of claim 1, wherein a concavity of the internal member profile increases from a valley tip to an inflection point and has a finite maximum near the inflection point.

8. The progressive cavity pump or positive displacement motor of claim 1, further comprising a sealing line between the external member and the internal member, wherein a two-dimensional projection of the sealing line is an ellipse, a limaçon, or a closed convex spline.

9. The progressive cavity pump or positive displacement motor of claim 8, wherein a center of the internal member is located on a major semi-axis of the ellipse.

10. A bottom hole assembly, comprising:

a drill bit at a distal end of a drill string; and the positive displacement motor of claim 1 axially above the drill bit.

11. A progressive cavity pump or positive displacement motor, comprising:

an external member;

an internal member within the external member; and a two-dimensional contact line that is a projection of a three-dimensional sealing line between the internal member and the external member, wherein one of the internal member and the external member rotates with respect to the other, wherein the two-dimensional contact line is an ellipse, a limaçon, or a closed convex spline.

12. The progressive cavity pump or positive displacement motor of claim 11, wherein a curvature of a profile of each of the internal member and external member is finite at all points.

13. The progressive cavity pump or positive displacement motor of claim 11, wherein a ratio of a lobe volume of the external member to a valley volume of the external member enclosed between a minor external member diameter and a major external member diameter is between 0.9 and 1.2.

14. The progressive cavity pump or positive displacement motor of claim 11, wherein a lobe height of the external member is related to a ratio of the minor diameter of the external member to one less than the number of the lobes of the external member.

15. The progressive cavity pump or positive displacement motor of claim 11, wherein a concavity of the internal member profile increases from a valley tip to an inflection point and has a finite maximum near the inflection point.

16. A bottom hole assembly, comprising:

a drill bit at a distal end of a drill string; and the positive displacement motor of claim 11 axially above the drill bit.

* * * * *